United States Patent [19]

Luska et al.

[11] Patent Number: 4,749,363

[45] Date of Patent: Jun. 7, 1988

[54] EXTENSION CORD SAFETY BOX

[76] Inventors: Robert Luska, 11240 39th Ave., Kenosha, Wis. 53142; David Truax, 2110 89th St., Kenosha, Wis. 53140

[21] Appl. No.: 25,020

[22] Filed: Mar. 12, 1987

[51] Int. Cl.[4] ..... H01R 13/50

[52] U.S. Cl. ..... 439/367; 439/369; 439/521

[58] Field of Search ..... 439/367, 369, 521, 147; 174/92, 138 F

[56] References Cited

U.S. PATENT DOCUMENTS

| | | | |
|---|---|---|---|
| 3,183,302 | 5/1965 | Wochner et al. | 174/92 |
| 3,683,314 | 8/1972 | Elkins | 439/367 |
| 4,227,764 | 10/1980 | Fiske | 439/367 |
| 4,229,616 | 10/1980 | Hotchkiss | 439/521 |
| 4,382,649 | 5/1983 | Meyer | 439/147 |
| 4,643,505 | 2/1987 | House et al. | 439/369 |

*Primary Examiner*—John McQuade

*Attorney, Agent, or Firm*—Joseph T. Kivlin, Jr.

[57] ABSTRACT

A junction box for extension cords which serves to secure the point at which extension cords are joined together in order to prevent access to such juncture and protect against an electric shock.

4 Claims, 2 Drawing Sheets

EXTENSION CORD SAFETY BOX

FIELD OF INVENTION

This invention relates to protective wiring devices, particularly devices adapted to prevent access to the junction of an extension cord and the cords for appliances plugged into it.

BACKGROUND OF INVENTION

It is generally known to provide a protective cover for the junction of multiple electrical cords or cables. The purpose of the protective devices of the prior art have been variously described as to facilitate rough handling without disconnecting the junction, to provide waterproof and dustproof connections, to provide electrical insulation of the junction and to prevent its accidental detachment or disengagement. Such devices are shown in U.S. Pat. Nos. 3,014,194 and 3,030,601 which disclose devices for the Protection of single outlet extention cords. U.S. Pat. Nos. 3,683,314 and 4,382,649 disclose means to prevent the disengagement of Data and communication cables.

In addition, U.S. Pat. No. 4,408,813 discloses a means to prevent access to the unused outlets of a multiple outlet device such as would be found on the end of an extension cord, known as a cube tap. Such device having two female outlets on one side and a single female outlet on the opposite side.

It is an object of the present invention to provide a safety box for the junction of an extension cord having a cube tap at its extremity.

It is a further object of this invention to provide a safety box for such junction in order to prevent access by children or pets.

Finally, it is an object of this invention to provide such safety box in a form which is readily and conveniently manufactured to minimize its cost.

SUMMARY OF THE INVENTION

In accordance with the present invention, an extension cord safety box is provided which is specifically designed to accommodate the cords which may be attached to a triple tap-type of extension cord terminus.

Preferably the safety box of the present invention is molded in a single unit from a suitable plastic material, such as polypropylene. This material is suitable because of its dielectric properties and because it is sufficiently flexible to form a hinge for the closure of the device. In addition the closure is provided with a plurality of detents which prevent the device from being inadvertently or easily opened, thereby rendering it childproof and petproof.

DESCRIPTION OF PREFERRED EMBODIMENT

Figure 1:
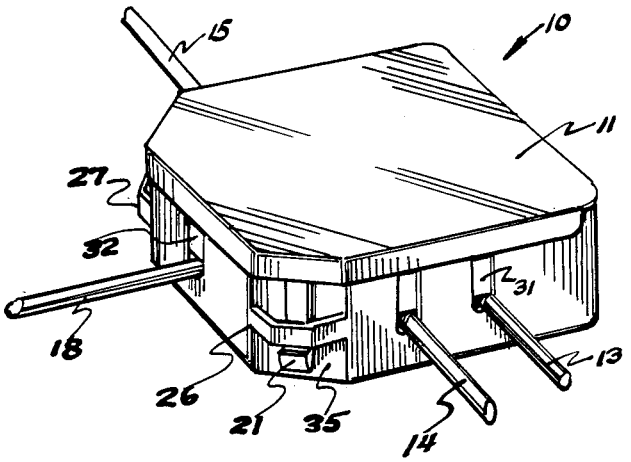
FIG. 1 is a perspective view of the extension cord safety box in the closed position with the extension and appliance cords extending therefrom.

Referring to the drawings in detail, the extension cord safety box of this invention is shown at 10. The box comprises a cover 11 which is attached by means of a hinge 20 to the rear wall 40 of the box. The side walls have slots 23, 24 and 25 and the front wall has slot 28 therein. The two oblique walls 35 and 36 join the front wall of the safety box to the two side walls and are each provided with a strap 26 and 27 and with reinforcing braces 40 and 41 respectively.

The cover 11 of the safety box is provided with slot closure plates or skirts 30, 31 and 32 and with hooks 21 and 22, each of the latter having a rib 33 and 34 respectively disposed perpendicularly to the main axis of the hook. The closure plates are designed to be positioned against the inner surface of their respective side walls when cover 11 is in the closed position.

Figure 2:
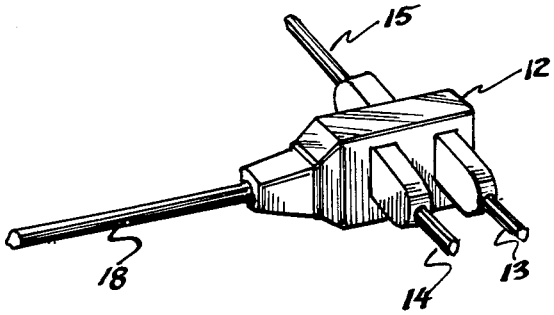
FIG. 2 is an exploded perspective view of the extension cord safety box in an open position, also showing the extension cord with a cube tap at its extremity and a plurality of appliance cords attached thereto.
Figure 2:
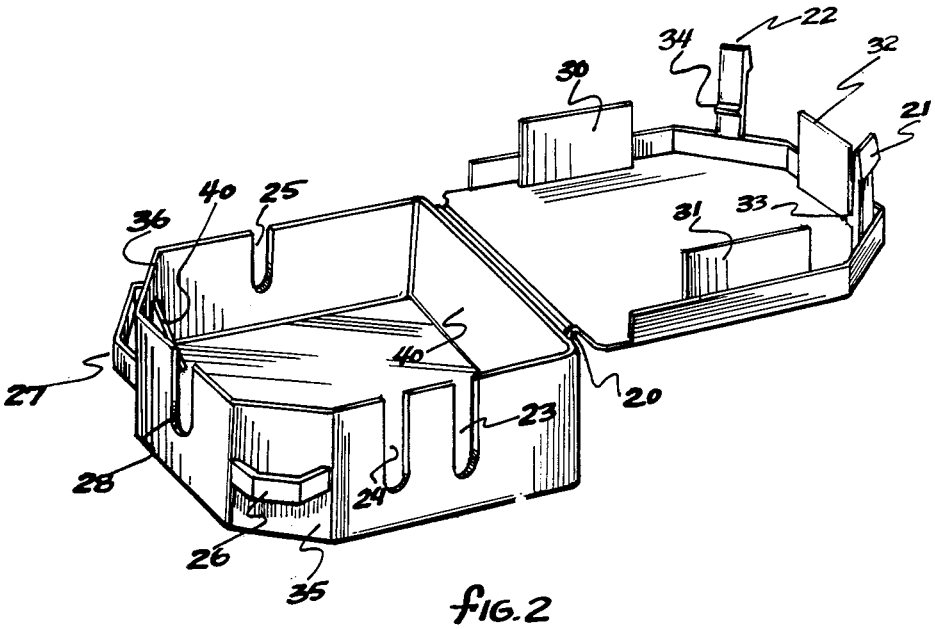
Figure 3:
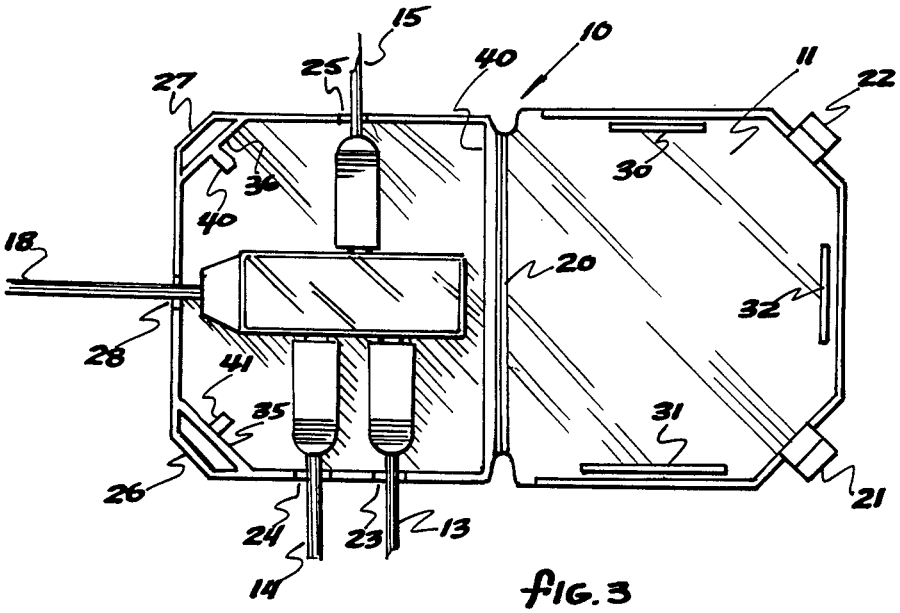
FIG. 3 is a top plan view of the extension cord safety box in an open position with the extension and appliance cords shown attached and in place.
Figure 4:
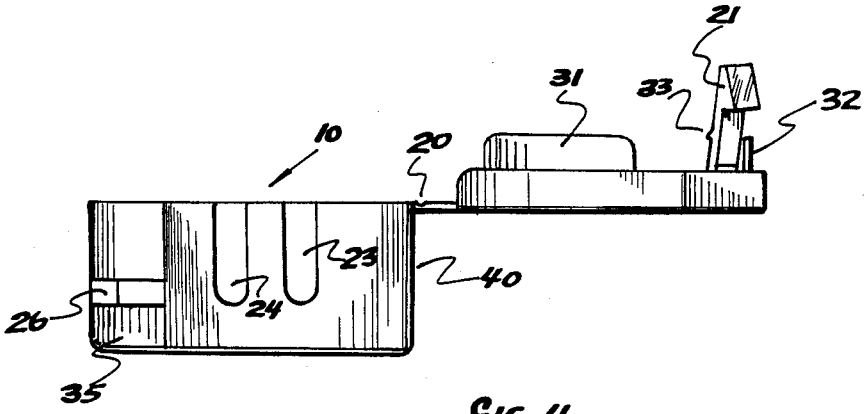
FIG. 4 is a side elevation of the extension cord safety box in an open position.

The extension cord safety box of the present invention is designed to provide physical separation of a child and/or pet from the junction of an extension cord terminating in a cube tap, such as that shown in FIG. 2, wherein the extension cord is identified at 18, the cube tap 12 and the appliance cords 13, 14 and 15.

When the safety box of the present invention is closed as shown in FIG. 1, its dimensions are such as to closely confine the junction of the triple tap and the appliance plugs connected thereto. As is best shown in FIG. 1, the closure plates 31 and 32 help to prevent the movement of the appliance cords plugged into the tap, to minimize the extent to which the side walls of the box may be depressed, and to close the upper portion of slots 23, 24, and 28. Closure Plate 30 closes the upper portion of slot 25.

The safety of the present device is assured by the means provided to keep cover 11 from being opened accidentally or by the play of pets or small children. Hooks 21 and 22 will engage the straps 26 and 27 as best shown in FIG. 1. Such engagement being aided by the provision of the ribs 33 and 34 respectively on said hooks. Moreover, the braces 40 & 41 prevent the oblique walls from being easily depressed to disengage said hooks. The transverse ribs engage the oblique walls and retain the hooks in engagement with their respective straps. Thus, in order to open said closure, it is necessary to depress both hooks simultaneously against the oblique walls in order to disengage the hooks from the straps, an operation which would be difficult, if not impossible, for small hands to accomplish.

By the use of the present invention, the junction of a cube tap and one or more appliance cords is protected against a child or pet coming in contact with an exposed wire or blade of a plug because the junction of the cube tap and the appliance cord is completely enclosed. Even if an appliance plug should become partly disengaged from the cube tap, the present invention prevents children or pets from having access to it.

The preferred embodiment of this invention has been illustrated and described with three appliance cords. It is obvious however that the invention is not limited to the use with a three-connector junction and that it may be used in other arrangements with the same advantages. Two appliance cords or even one attached to the triple tap would be protected as well as the three which are shown.

The extension cord safety box of the present invention can be molded in a unitary construction from any suitable thermoplastic resin. While polypropylene is preferred because of its flexibility and toughness, other resins such as polyethylene are operable.

What is claimed is as follows:

1. A safety box for the junction of an extension cord terminating in a cube tap and one or more appliance cords comprising:

a box having a generally square configuration with a cover connected by a hinge to the upper margin of one wall, the other three walls being provided with slots for receiving said cords;

said box further having oblique walls joining the slotted walls, with said oblique walls each having a strap spaced therefrom;

said hinged cover being provided with plates or skirts for partially closing said slots, when said box is closed;

said cover being also provided with hooks for engaging said straps when said cover is in its closed position;

whereby said extension cord junction is inaccessible when closed inside of said safety box with hooks engaged.

2. A safety box as defined in claim 1 wherein the engagement of said hooks & straps is made secure by a transverse rib on each hook, and a reinforcing brace secured to each oblique wall.

3. A safety box as defined in claim 2 which is fabricated from a thermoplastic resin.

4. A safety box as defined in claim 3 in which the resin is polypropylene.

* * * * *